US010538426B2

(12) United States Patent
Aksoyek

(10) Patent No.: US 10,538,426 B2
(45) Date of Patent: Jan. 21, 2020

(54) SADDLE

(71) Applicant: IKONIC SADDLERY, Lasne (BE)

(72) Inventor: Ozan Tolga Aksoyek, Lasne (BE)

(73) Assignee: IKONIC SADDLERY, Lasne (BE)

( * ) Notice: Subject to any disclaimer, the term of this patent is extended or adjusted under 35 U.S.C. 154(b) by 237 days.

(21) Appl. No.: 15/497,597

(22) Filed: Apr. 26, 2017

(65) Prior Publication Data

US 2017/0313572 A1 Nov. 2, 2017

(30) Foreign Application Priority Data

Apr. 27, 2016 (EP) ..... 16167321

(51) Int. Cl.
*B68C 1/04* (2006.01)
*B68C 1/12* (2006.01)

(52) U.S. Cl.
CPC ..... *B68C 1/04* (2013.01); *B68C 1/12* (2013.01); *B68C 2001/044* (2013.01)

(58) Field of Classification Search
CPC ..... B68C 1/04; B68C 2001/042; B68C 2001/044; B68C 2001/046; B68C 2001/048; B68C 1/02; B68C 1/025; B68C 1/12; B62J 1/00; B62J 1/002; B62J 1/005; B62J 1/007; B62J 1/02; B62J 1/04; B62J 1/06; B62J 1/065; B62J 1/08; B62J 2001/085; B62J 1/10; B62J 1/18; B62J 1/20; B62J 1/22; B62J 1/24; B62J 1/26

See application file for complete search history.

(56) References Cited

U.S. PATENT DOCUMENTS 2,208,303 A * 7/1940 Frueh ..... B68C 1/02 54/44.4
3,286,440 A * 11/1966 Walker ..... B68C 1/02 54/44.7
3,835,621 A * 9/1974 Gorenschek ..... B68C 1/02 54/44.7

(Continued)

FOREIGN PATENT DOCUMENTS

DE 202012101416 U1 * 5/2012 ..... B68C 1/025
DE 102012106008 A1 5/2014

(Continued)

OTHER PUBLICATIONS

European Patent Office Search report dated Oct. 7, 2016 re European Application No. 116167321.5 of Ikonic Saddlery.

*Primary Examiner* — Kathleen I Alker
(74) *Attorney, Agent, or Firm* — Patrick J. Daugherty; Daugherty & Del Zoppo Co., LPA

(57) ABSTRACT

Saddle comprising a central part having a top surface for providing a seat to a rider, a lower surface having a curvature for adapting to a back of a horse, elongated pad members coupled to said central part for forming a cushion, connecting places for mechanically coupling a reinforcing member to said central part for imposing a given curvature to said lower surface. The saddle is characterized in that it further comprises a hinge, mechanically coupled to the lower surface of the central part, for facilitating a modification of said curvature, and for coupling a reinforcing member to said central part, said connecting places being located on a portion of the hinge that is accessible from the lower surface of the central part.

13 Claims, 2 Drawing Sheets

(56) References Cited

U.S. PATENT DOCUMENTS

| | | | | | |
|---|---|---|---|---|---|
| 5,175,986 | A * | 1/1993 | Farley | B68C 1/12 | 54/44.1 |
| 8,020,362 | B2 * | 9/2011 | Kroetch | B68C 1/025 | 54/44.3 |
| 8,863,482 | B2 * | 10/2014 | Diaz | B68C 1/025 | 54/44.3 |
| 8,899,004 | B2 * | 12/2014 | Strauss | B68C 1/025 | 54/44.3 |
| 8,997,444 | B2 * | 4/2015 | Konzet | B68C 1/025 | 54/44.1 |
| 2005/0120683 | A1 * | 6/2005 | Swain | B68C 1/025 | 54/44.1 |
| 2015/0047302 | A1 * | 2/2015 | Merlin | B68C 1/04 | 54/44.3 |

FOREIGN PATENT DOCUMENTS

| | | | | | |
|---|---|---|---|---|---|
| EP | 1911719 | A1 | | 4/2008 | |
| GB | 191309377 | A | * | 2/1914 | B68C 1/04 |
| GB | 191418567 | A | * | 8/1915 | B68C 1/04 |
| GB | 2423230 | A | | 8/2006 | |

* cited by examiner

SADDLE

TECHNICAL FIELD

The invention relates to the field of saddlery. More precisely, the invention relates to a saddle. The inventors also propose a saddlery kit comprising the saddle of the invention and a plurality of reinforcing members.

PRIOR ART

Generally, saddles have a determined angular opening or curvature. Therefore, they do not adapt to different sizes of horses, or not easily. They are said static. For riding horses of different sizes, one then needs to use different saddles.

An adjustable saddle is disclosed in EP1911719B1. It comprises a plate (named headplate) having a flexibility permitting it to resiliently and angularly deform to accommodate to different reinforcing members of different angular openings. These reinforcing members are rigid. By coupling the saddle with one of these reinforcing members, one can obtain a saddle that has a rigidity high enough for riding a horse. The reinforcing members have a shape of inverted V of different angular openings or curvatures. Depending on the horse size, one reinforcing member is chosen. Fixation means allow coupling one of them to the saddle.

The solution disclosed in EP1911719B1 presents several drawbacks. Mainly, placing or changing a reinforcing member for adapting to a horse having a specific size is relatively complicate. This procedure is also relatively long.

SUMMARY OF THE INVENTION

One of the objects of the present invention is to provide a saddle that can adapt to horses of different sizes more easily, and more rapidly. To this end, the inventors suggest a saddle comprising:

- a central part having:
  - a top surface for providing a seat to a rider;
  - a lower surface having a curvature for adapting to a back of a horse;
  - flexibility for allowing modifying said curvature;
- two side panels located at two opposite sides of said central part;
- elongated pad members coupled to said central part for forming a cushion on at least a portion of the lower surface of said central part;
- connecting places for mechanically coupling a reinforcing member to said central part for imposing a given curvature to said lower surface.

The saddle of the invention is characterized in that:

- it further comprises a hinge, mechanically coupled to the lower surface of said central part, for facilitating a modification of said curvature, and for coupling a reinforcing member to said central part, and in that
- the connecting places are located on a portion of the hinge that is accessible from the lower surface of the central part (even when the two side panels and the elongated pad members are positioned for a normal use of the saddle).

Preferably, the saddle has two elongated pad members. Generally, the elongated pad members form a cushion on the lower surface of the saddle (or of the central part) when the saddle is placed on a back of a horse.

The hinge allows coupling a reinforcing member to the central part through it (through the hinge).

For placing or changing a reinforcing member, one has to apply a lower pressure to the saddle in order to adapt it to the angular opening or curvature of the chosen reinforcing member. This is possible thanks to the presence of the hinge that deform more easily than the headplate of EP1911719B1. Finally, the saddle of the invention can adapt to different sizes of horses more easily.

Connecting places are located on a portion of the hinge that is accessible from the lower surface of the central part of the saddle. In particular, a user can access these connecting places even when the two sides panels and the elongated pad members are in a position corresponding to a normal use of the saddle. So, contrary to the solution of EP1911719B1, it is not necessary, with the saddle of the invention, to dislodge or remove the sides panels (named skirt panels in EP1911719B1) and/or pad members (see [0027] and FIG. 6 of EP1911719B1), for placing, removing or changing a reinforcing member. Hence, the saddle of the invention can adapt to different sizes of horses more easily, and in a shorter time.

Once a suitable reinforcing member has been chosen and coupled to the main body, the saddle of the invention has a rigidity high enough for riding a horse.

The system according to the invention features other advantages. Connecting places are accessible from the lower side of the saddle (or from the lower surface of the central part). This allows having a nice top surface: the connecting places are not visible when the saddle is on a horse, and in a normal storage position where typically it is the top side (seat side) that is visible. Hence, the saddle of the invention is particularly aesthetic. And it is not necessary to have pieces of leather for recovering the connecting places as they are located on the lower side of the saddle. This allows decreasing time and fabrication costs of the saddle when one wants to have an aesthetic saddle.

Top surface of central part corresponds to a top side of the saddle (or rider side). Lower surface of central part corresponds to a lower side of the saddle (or horse side). Normal use of the saddle corresponds to a case where the saddle can be placed on a back of a horse, for a rider to ride.

The inventors propose several preferred embodiments comprising optional features; some of them can be combined as reflected by the claims dependencies.

Preferably, the saddle comprises connecting means for fixing the hinge to the central part of the saddle.

Preferably, by removing these connecting means, one can uncouple the hinge from the central part. Then, fabrication is easier as the different elements can be made separately, and thereafter assembled.

Preferably, said connecting means are covered by the elongated pad members. Connecting means for coupling the hinge to central part are covered by the elongated pad members when these latter are positioned for a normal use of the saddle (case where the saddle can be placed on a back of a horse, for a rider to ride), and when said hinge is connected to central part of course (configuration of the saddle corresponding to claim 1). Hence, thanks to this embodiment, the connecting means are not visible, increasing the aesthetic quality of the saddle. As the connecting means are covered by the elongated pad members, there is a smaller risk that they hurt a horse or a user.

Preferably, the elongated pad members can be at least partly uncoupled from the central part of the saddle. This allows accessing the connecting means fixing the hinge to the central part when the latter are covered by the elongated pad members in a position for a normal use of the saddle.

This presented preferred embodiment could be used alone or in combination with one or more preferred embodiments previously presented.

Indeed, the connecting means for fixing the hinge to the central part are preferably accessible when the elongated pad members are partly uncoupled from said central part. This presented preferred embodiment could be used alone or in combination with one or more preferred embodiments previously presented. With this preferred embodiment, accessing the connecting means used for coupling the hinge to central part is easier when the latter are covered by the elongated pad members for a normal use of the saddle. Connecting places are accessible from the lower surface of the central part even when elongated pad members are in place for a normal use.

Preferably, the lower surface of the central part comprises a flexible plate, and the hinge is mechanically coupled to the flexible plate. This presented preferred embodiment could be used alone or in combination with one or more preferred embodiments previously presented. Coupling (preferably fixing) the hinge to the lower surface of the central part is easier when the latter comprises such a flexible plate. Thanks to the presence of the hinge, one can use a flexible plate that is more flexible than the one of EP1911719B1: in particular, here, the reinforcing member can be coupled to the hinge, and not directly to the flexible plate. This allows using a flexible plate that is less rigid, and less thick. Finally, placing a reinforcing member to the saddle is still easier with the preferred embodiment of the invention, as there is less resistance from the flexible plate as it can be less rigid, less thick. Preferably, the flexible plate is made of a plastic or polymer material.

Preferably, the hinge comprises two hinge elements that can rotate with respect to each other around a hinge axis. This presented preferred embodiment could be used alone or in combination with one or more preferred embodiments previously presented. Preferably, each of said two hinge elements presents a portion traversed by said main hinge axis that has a smaller width than another outer portion of each hinge element, each of said wider outer portions of each hinge element forming a stop for blocking a reinforcing member around said hinge axis. Positioning of a reinforcing member is facilitated by the presence of these two stops. They prevent the reinforcing member from sliding along the hinge when these two elements are not coupled, typically before securing the reinforcing member to the hinge. By placing one reinforcing member between these two stops, it is blocked, allowing an easier later fastening to the hinge.

Preferably, each outer portion of each hinge element is at least partly covered by one elongated pad member. Aesthetic aspect and comfort of the saddle are further increased with this preferred embodiment. Preferably, each outer portion is totally covered by an elongated pad member.

Preferably, the saddle further comprises a piece of tissue for covering said connecting places, coupled to the lower surface of the central part such that it can be lifted for accessing said connecting places. This presented preferred embodiment could be used alone or in combination with one or more preferred embodiments previously presented. This allows improving the aesthetic aspect of the saddle, even on its lower side. As the connecting places can be covered by this piece of tissue (leather for instance), any risk of hurting by connecting means placed at the connecting places for coupling a reinforcing member with a hinge is further decreased. As the hinge is generally metallic, the piece of tissue also allows avoiding a contact with a cold metallic element.

Preferably, the saddle further comprises a reinforcing member coupled to the hinge at the connecting places. Preferably, the reinforcing member has a recess for accommodating with the hinge. Then, placing and positioning the reinforcing member along the hinge is further facilitated. Then, the reinforcing member preferably has two sides delimiting the recess and that can block the reinforcing member between two stops of the hinge.

The inventors also propose a saddlery kit comprising a saddle according to the invention, and a plurality of reinforcing members. This presented saddlery kit could be used alone or in combination with one or more preferred embodiments previously presented. Generally, a reinforcing member has a shape close to a V (or inverted V) (see figures below) for adapting the lower surface of the central part of the saddle to the shape of back of a horse. Preferably, screws or other fixation means are used for coupling the reinforcing member to the hinge at the connecting places. Then, the hinge preferably comprises holes (preferably threaded holes) at said connecting places for receiving these screws or other fixation means.

Preferably, the saddlery kit comprises a plurality of reinforcing members of different sizes for accommodating the lower surface of the central part to different sizes of horses.

BRIEF DESCRIPTION OF THE FIGURES

These aspects of the invention as well as others will be explained in the detailed description of specified embodiments of the invention, with reference to the drawings in the figures, in which.

The drawings in the figures are not to scale. Generally, similar elements are designated by similar reference signs in the figures. The presence of reference numbers in the drawings is not to be considered limiting, even when such numbers are also included in the claims.

DETAILED DESCRIPTION OF POSSIBLE EMBODIMENTS OF THE INVENTION

Figure 1:
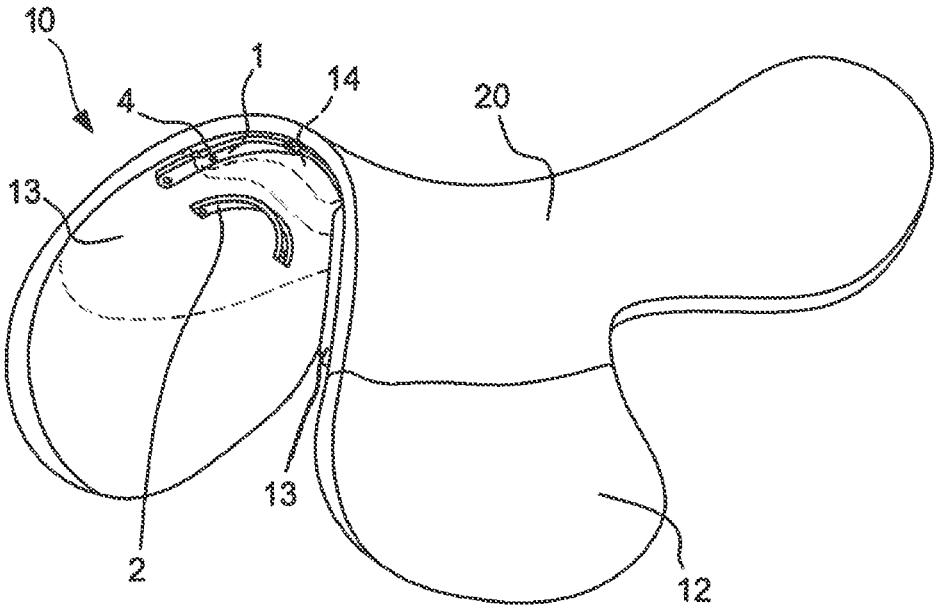
FIG. 1 shows an exemplary embodiment of a saddle according to the invention.

FIG. 1 shows an exemplary embodiment of the saddle 10 according to the invention. It comprises a central part 20 whose top surface provides a seat (or seat portion) for a rider. Generally, this top surface is in leather. Lower surface of the central part 20 has a curvature for adapting to a back of a horse. Generally, this lower surface is concave. In other words, this lower surface has an angular opening such that it forms an acute angle towards horse side. Top surface is therefore on the rider side, whereas lower surface is on the horse side. Central part 20 of the saddle 10 has a flexibility high enough for adapting to different sizes of horses by modifying the curvature of the lower surface of the central part 20.

The saddle 10 also has two side panels 12 (or two side parts, portions) located at two opposite sides of the central part 20. This side panels 12 can provide comfort and cushion to a rider by covering the horse where the rider's legs are positioned. Generally, such side panels 12 also facilitate the fastening of the saddle 10 on the back of a horse. Side panels 12 preferably comprise a leather covering. Central part 20 and side panels 12 can be part of a same piece, body. According to another possible embodiment, the side panels 12 and the central part 20 are distinct elements that are joined together, for instance by sewing.

The saddle 10 comprises on its lower side two elongated pad members 13 that are mechanically coupled to the central part 20. They form a cushion so that comfort is increased, both for the rider and the horse. Preferably, the elongated pad members 13 can be partly uncoupled from the central part 20 of the saddle 10, for instance at the front side of the saddle 10, that is the side that is closer to the head of the horse. In such a case, the elongated pad members 13 are preferably fixed permanently to the back side of the central part 20 of the saddle 10, for instance by sewing. The back side of the central part 20 (or of the saddle 10) corresponds to the side that is closer to the tail of the horse. For coupling and uncoupling the elongated pad members 13 to and from the front side of the central part 20, the saddle 10 preferably comprises two holes in the central part 20, and two threaded holes in the elongated pad members 13. One screw can be passed through one hole of the central part 20, and be screwed in a threaded hole of one elongated pad member 13, such that central part 20 and one elongated pad member 13 are coupled.

Figure 2:
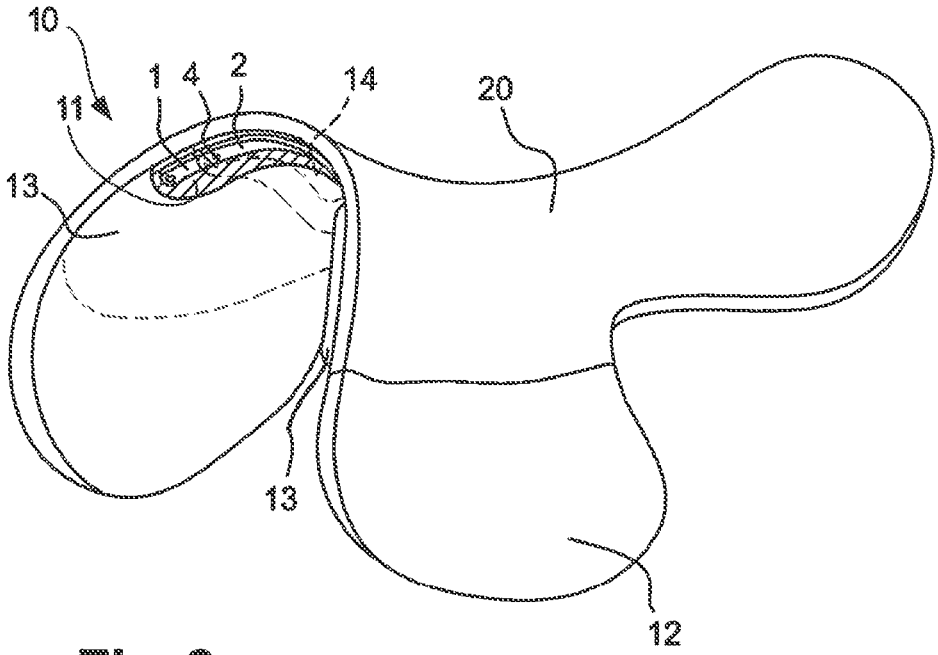
FIG. 2 shows another exemplary embodiment of a saddle according to the invention.

The saddle 10 further comprises a hinge 1 coupled to the central part 20 (on its lower surface). Preferably, said hinge 1 is fixed on a front side of the lower surface of the central part 20 (see FIG. 1). Preferably, connecting means 5 such as screws allow fixing the hinge 1 to the central part 20 (see FIG. 3). Preferably, said connecting means 5, fixing the hinge 1 to the central part 20, are covered by the elongated pad members 13 when the latter are coupled to the front side of the central part 20 (see FIGS. 1 and 2). Preferably, the connecting means 5 are accessible when the elongated pad members 13 are partly uncoupled from the central part 20 (from the front side of its lower surface for instance). The hinge 1 allows facilitating a modification of the curvature of the lower surface of the central part 20.

Preferably, the lower surface of the central part 20 comprises a flexible plate 11, and the hinge 1 is mechanically coupled to the flexible plate 11. This presented preferred embodiment could be used alone or in combination with one or more preferred embodiments previously presented. Preferably, the flexible plate 11 is made of a plastic or polymer material.

Figure 3:
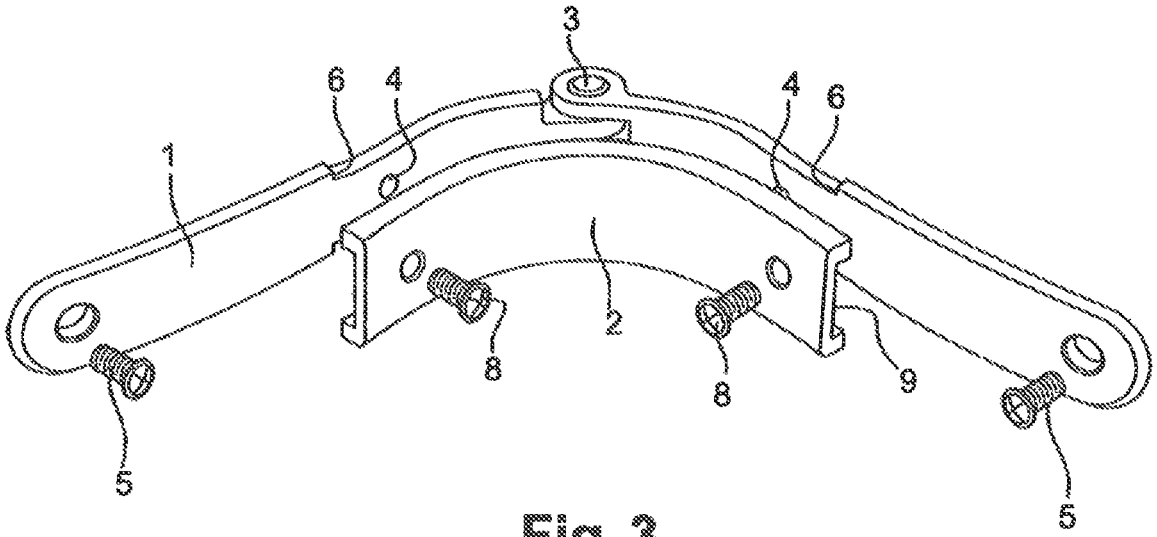
FIG. 3 shows a hinge, a reinforcing member, and connecting means for coupling them together.

FIG. 3 shows an example of a hinge 1 that can be used for the saddle 10, in combination with a reinforcing member 2. As shown in this figure, the hinge 1 generally has a hinge axis 3 around which two portions (two elements in FIG. 3) can rotate with respect to each other. Preferably, the hinge 1 has a central portion around the hinge axis 3 that is surrounded by two outer portions. As shown in FIG. 3, the central portion preferably has a larger width than the two outer portions. Then, there are two stops 6 that can be used for blocking a reinforcing member 2 around the hinge axis 3 before it is fixed to the hinge 1 (see FIG. 3). In the example of FIG. 3, the two elements of the hinge 1 that can rotate around the hinge axis 3 each present a portion of smaller width forming the central portion of width smaller than the one of the outer portions of the hinge 1. As shown in FIG. 3, the reinforcing member 2 preferably has a recess 9 for accommodating to the hinge 1. Then, the reinforcing member 2 preferably has two sides delimiting said recess 9 that can block said reinforcing member 2 between two stops 6 of the hinge 1.

For having a rigidity high enough for riding a horse, one has to couple a reinforcing member 2 to the saddle 10. Examples of reinforcing members 2 are shown in FIGS. 1 to 4. A reinforcing member 2 is an element having a relatively high rigidity such that it does not deform, or very slightly, when it is coupled to a saddle 10 and a rider sit on it for riding a horse.

The saddle 10 of the invention comprises connecting places 4 that are located on a portion of the hinge 1 and that are accessible to a user from the lower surface of the central part 20. The connecting places 4 allow coupling a reinforcing member 2 to the central part 20 of the saddle 10 for imposing a given curvature. They are accessible even when the side panels 12 and the elongated pad members 13 are positioned (or placed) for a normal use of the saddle 10. So, for accessing the connecting places 4, it is not necessary to remove or dislodge one of the elongated pad members 13 of side panels 12. According to a possible embodiment, the saddle 10 also comprises a piece of tissue 14 for at least partly covering the hinge 1. But even in that case, the connecting places 4 are accessible because the piece of tissue 14 is then coupled to the lower surface of the central part 20 such that it can then be lifted for accessing the connecting places 4. For coupling a reinforcing member 2 to the saddle 10, one has to fix it to the hinge 1 at the connecting places 4. Preferably, the hinge 1 comprises threaded holes at the connecting places 4 that can receive screws 8 used for fixing the reinforcing member 2 to it. Preferably, there are two connecting places 4.

Preferably, the reinforcing member 2 has a recess 9 for accommodating with the hinge 1 (see FIG. 3). Preferably, the saddle 20 also comprises connecting means such as screws 8 for connecting one reinforcing member 2 to the hinge 1, and so to the saddle 10.

The inventors also propose a saddlery kit comprising a saddle 10 as described previously and a plurality of reinforcing members 2. Preferably, each reinforcing member 2 has a recess 9 for accommodating with the hinge 1 (see FIG. 3).

Figure 4:
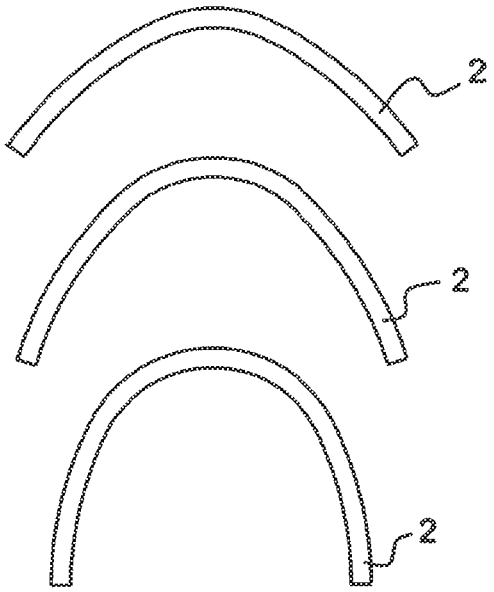
FIG. 4 shows a plurality of reinforcing members of different angular openings.

FIG. 4 shows a set of reinforcing members 2 that can be used for the saddlery kit of the invention. As shown, the reinforcing members 2 are preferably concave. Preferably, the curvature of the reinforcing members 2 can be modeled by a curve and second order. Preferably, the saddlery kit comprises from two to six reinforcing members 2 of different sizes or angular openings, more preferably between three to five, and still more preferably four reinforcing members 2.

The present invention has been described with reference to specific embodiments, the purpose of which is purely illustrative, and they are not to be considered limiting in any way. In general, the present invention is not limited to the examples illustrated and/or described in the preceding text. Use of the verbs "comprise", "include", "consist of", or any other variation thereof, including the conjugated forms thereof, shall not be construed in any way to exclude the presence of elements other than those stated. Use of the indefinite article, "a" or "an", or the definite article "the" to introduce an element does not preclude the presence of a plurality of such elements. The reference numbers cited in the claims are not limiting of the scope thereof.

In summary, the invention may also be described as follows. Saddle 10 comprising a central part 20 having a top surface for providing a seat to a rider, a lower surface having a curvature for adapting to a back of a horse, elongated pad members 13 coupled to said central part 20 for forming a cushion, connecting places 4 for mechanically coupling a reinforcing member 2 to said central part 20 for imposing a given curvature to said lower surface. The saddle is characterized in that it further comprises a hinge 1, mechanically coupled to the lower surface of the central part 20, for facilitating a modification of said curvature, and for coupling a reinforcing member 2 to said central part 20, said connecting places 4 being located on a portion of the hinge 1 that is accessible from the lower surface of the central part 20.

The saddle of the invention can be used for riding a horse, or other animals.

The invention claimed is:

1. A Saddle for equestrian use, comprising:

a central part having:

a top surface for providing a seat to a rider; and a lower surface having a curvature for adapting to a back of a horse and formed with flexibility for allowing modifying of said curvature;

two side panels located at two opposite sides of said central part;

elongated pad members coupled to said central part for forming a cushion on at least a portion of the lower surface of said central part;

connecting places for mechanically coupling a reinforcing member to said central part for imposing a given curvature to said lower surface; and a hinge mechanically coupled to the lower surface of said central part configured to facilitate a modification of said curvature of said lower surface, and for coupling the reinforcing member to said central part, wherein said connecting places are located on a portion of said hinge that is accessible from the lower surface of the central part.

2. The saddle according to claim 1, further comprising:

connecting means for fixing said hinge to said central part.

3. The saddle according to claim 2 characterized in that said connecting means for fixing said hinge to said central part are covered by said elongated pad members.

4. The saddle according to claim 3 characterized in that the connecting means for fixing said hinge to said central part are accessible when said elongated pad members are partly uncoupled from said central part.

5. The saddle according to claim 1 characterized in that said elongated pad members are configured to be at least partly uncoupled from said central part.

6. The saddle according to claim 1 characterized in that said lower surface of said central part comprises a flexible plate, and in that said hinge is mechanically coupled to said flexible plate.

7. The saddle according to claim 1 characterized in that said hinge comprises two hinge elements that can rotate with respect to each other around a hinge axis.

8. The saddle according to claim 7 characterized in that each of said two hinge elements presents a portion traversed by said hinge axis that has a smaller width than another outer portion of each hinge element, each of said wider outer portions of each hinge element forming a stop for blocking the reinforcing member around said hinge axis.

9. The saddle according to claim 8 characterized in that each outer portion is at least partly covered by one of the elongated pad members.

10. The saddle according to claim 1 further comprising:

a piece of tissue covering said connecting places and coupled to the lower surface of the central part such that it can be lifted for accessing said connecting places.

11. The saddle according to claim 1, further comprising:

the reinforcing member coupled to the hinge at said connecting places.

12. The saddle according to claim 11 characterized in that said reinforcing member defines a recess for accommodating said hinge.

13. The saddle according to claim 1, further comprising:

a plurality of reinforcing members of different sizes that are each configured for coupling to the hinge at said connecting places, the different sizes accommodating different sizes of horses.

* * * * *